US005640738A

United States Patent [19]

Williams et al.

[11] Patent Number: 5,640,738

[45] Date of Patent: Jun. 24, 1997

[54] WET AND DRY VACUUM CLEANER

[76] Inventors: William H. Williams, 4938 Golden Arrow Dr., Ranch Palos Verdes, Calif. 90274; Paul G. Jacobs, 9958 Amestoy Ave., Northbridge, Calif. 91325

[21] Appl. No.: 510,324

[22] Filed: Aug. 2, 1995

[51] Int. Cl.[6] ..... A47L 7/00

[52] U.S. Cl. ..... 15/320; 15/353

[58] Field of Search ..... 15/320, 321, 322, 15/347, 353, 401

[56] References Cited

U.S. PATENT DOCUMENTS

| | | | |
|---|---|---|---|
| 3,020,576 | 2/1962 | Gerber | 15/320 |
| 3,040,362 | 6/1962 | Krammes | 15/320 |
| 3,040,363 | 6/1962 | Krammes et al. | 15/320 |
| 3,060,484 | 10/1962 | Krammes | 15/320 |
| 3,117,337 | 1/1964 | Krammes | 15/320 |
| 3,540,072 | 11/1970 | Wolter et al. | 15/320 |
| 4,196,492 | 4/1980 | Johnson et al. | 15/320 |
| 4,210,978 | 7/1980 | Johnson et al. | 15/320 |
| 4,267,617 | 5/1981 | Brown et al. | 15/320 |
| 4,956,891 | 9/1990 | Wulff | 15/320 |

FOREIGN PATENT DOCUMENTS

| | | | |
|---|---|---|---|
| 1229687 | 12/1966 | Germany | 15/320 |

*Primary Examiner*—Tony G. Soohoo

*Attorney, Agent, or Firm*—Joseph E. Mueth

[57] ABSTRACT

A floor cleaning machine having a body carrying a separable rigid vacuum-retaining container, within said container, a flaccid container, means for lifting said containers as a unit from the body of the machine for disposing of spent and unspent liquids contained therein, cleaning the containers, and re-filling with fresh cleaning fluid. In a preferred embodiment, the machine is provided with a full floating squeege which enables the machine to be moved from carpeted surfaces to hard floor surfaces by the simple flip of a handle.

10 Claims, 8 Drawing Sheets

WET AND DRY VACUUM CLEANER

BACKGROUND OF THE INVENTION

Various floor cleaning machines are known which apply the principle of a flexible bladder or membrane to reduce the overall size and weight of the cleaning machine by using the same tank space twice with the use of a flexible and movable inner container.

U.S. Pat. No. 3,896,520 discloses a vacuum cleaner which includes a rigid vacuum-retaining outer case which acts as a clean liquid reservoir, a flaccid spent liquid-retaining container within the case, a vacuum motor for creating vacuum within the case around the flaccid container including an inlet communicating with the case. The device has means communicating with the flaccid container for drawing discharged liquid and included dirt from the surface to be cleaned into the flaccid container under the influence of vacuum, so that the container fills with used liquid at a volume rate essentially equal to the rate of depletion of the unused liquid. The used or dirty liquid is disposed of by removing the top of the machine and dumping the liquid out. The rigid vacuum-retaining outer case is an integral part of the machine and cannot be separated from the machine for cleaning or re-filling.

U.S. Pat. No. 4,196,492 discloses a carpet cleaning machine comprising a body which includes a flexible bag for holding fresh cleaning solution which is received in an external rigid storage chamber. Spent dirty cleaning solution is collected in the external rigid storage chamber. The machine carries a scrubbing unit or means for cleaning the carpet. The scrubbing means includes a nozzle means for applying fresh cleaning solution to the carpet and a vacuum means for removing the spent cleaning solution from the carpet. In U.S. Pat. No. 4,210,978, the flexible bag is replaced by a plastic membrane.

The flexible bag is permanently mounted in place and cannot be removed for cleaning of the spent dirty solution rigid storage chamber without major dis-assembly of the whole unit. Even though the bag is filled with clean water, inevitably the interior of the bag becomes contaminated with minerals and other deposits, and the exterior storage chamber becomes contaminated by dirty water. With the flexible bag being permanently mounted to both the bottom spray head outlet and to the top part of the rigid tank body, it is inevitably subject to hazardous bacterial growth without the needed access for proper cleaning of the spent dirty solution tank which is exterior to the non-removable flexible bag. The external rigid storage chamber is a permanent part of the machine itself.

U.S. Pat. No. 4,210,978 relates to a carpet cleaning machine comprising a body which carries a rigid storage chamber for holding fresh cleaning solution and a second storage chamber for receiving spent cleaning solution. A flexible membrane or partition divides an enclosed rigid cavity in the body into the first and second storage chambers. The flexible membrane is permanently affixed (ref. page 12, line 30–35) at its extremities to the rigid cavity in the body such that there is severe stress when the second chamber is full of spent liquid. The membrane is not readily removable and inevitably becomes contaminated by the dirty spent cleaning liquid. This presents the same hazardous bacterial growth problem as the previously discussed U.S. Pat. No. 4,196,492. The rigid storage chamber is not adapted to be separated from the machine.

Still further, U.S. Pat. No. 4,956,891 describes a floor cleaning machine comprising a support structure including a housing having a rigid water chamber, an inner spherical flexible container within the water chamber defining an inner chamber for retention of clean water. The spherical chamber is at the bottom permanently fixed to the spray head system outlet and at the top to the rigid tank body and thus is not adapted for ready removal from the machine. Therefore, the exterior of the flexible container and the return rigid waste tank surface becomes contaminated by dirty liquid and cannot be effectively cleaned without major disassembly of the whole unit, and thus will have the same hazardous bacterial growth problem as the previous discussed U.S. Pat. Nos., 4,196,492 and 4,210,492. The rigid water chamber is essentially integral with the machine which does not facilitate its separation from the machine.

The present invention provides a novel cleaning machine in which both the rigid vacuum retaining outer container and the inner flaccid container are adapted to be lifted as a unit from the machine and handled much as an ordinary scrub bucket for purposes of emptying, cleaning and sanitizing, and refilling with fresh cleaning liquid, followed by re-installation in the machine. This approach is very user friendly by appealing to the user who is already familiar with the use of scrub buckets.

SUMMARY OF INVENTION

Briefly, this invention comprises a floor cleaner having:

a body carrying a removable rigid clean liquid container, a flaccid removable container within said rigid clean liquid container serving as a reservoir for return spent liquid, means for creating vacuum within said rigid clean liquid container in and around said flaccid container including an inlet communicating with said rigid clean liquid container, means communicating with said rigid clean liquid container for discharging liquid on a surface to be cleaned, and means communicating with said flaccid container for drawing said liquid and included dirt from said surface to be cleaned into said flaccid container under the influence of vacuum whereby said flaccid container can fill with used liquid at a volume rate essentially equal to the rate of depletion of the unused liquid; the improvement comprising means for lifting said rigid clean liquid container and said flaccid container as a unit from the body of the machine for disposing of spent and unspent liquids, cleaning the containers, and re-filling of said rigid clean liquid container. In a preferred embodiment, the machine is provided with a full floating squeege which enables the machine to be moved from carpeted surfaces to hard floor surfaces by the simple flip of a handle.

THE DRAWINGS

Turning to the drawings:

FIG. 5 shows the combined inner and outer containers separated from the machine and the contained liquids being disposed of;

DESCRIPTION OF PREFERRED EMBODIMENTS

Figure 1:
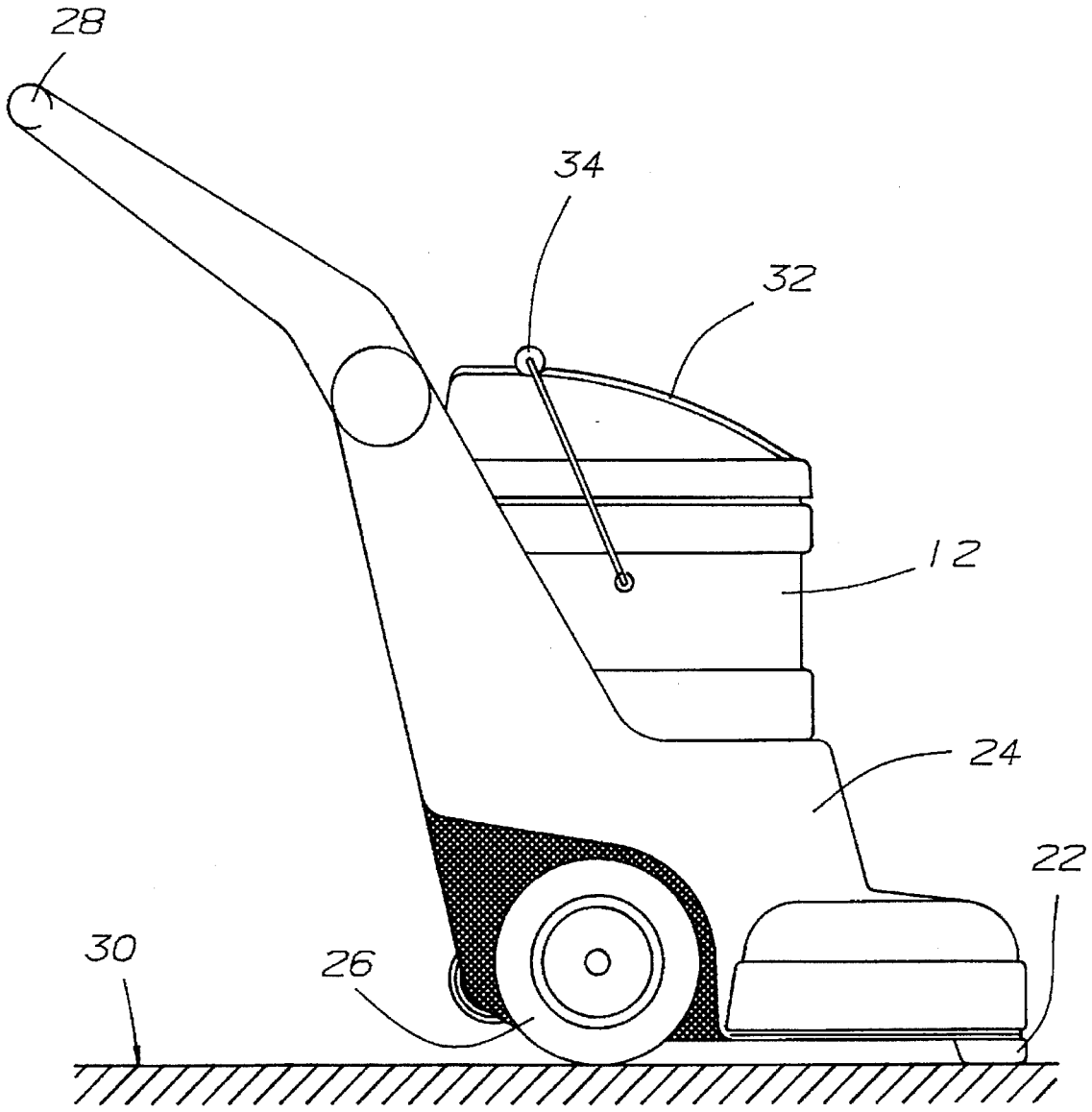
FIG. 1 is a side plan view of the preferred embodiment of this invention.
Figure 2:
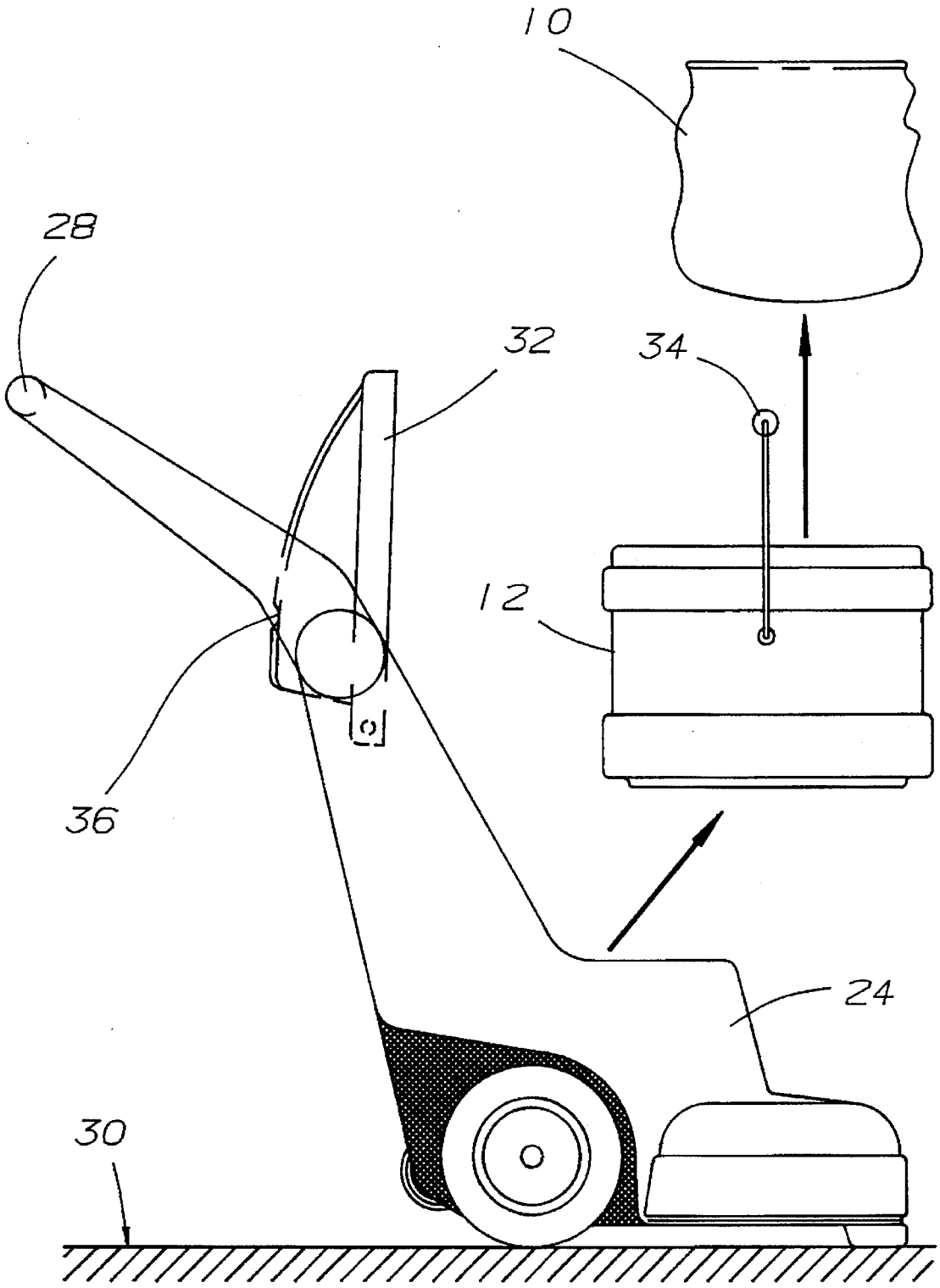
FIG. 2 is a side view of the machine of FIG. 1 showing how the containers can be separated from the body of the machine.
Figure 3:
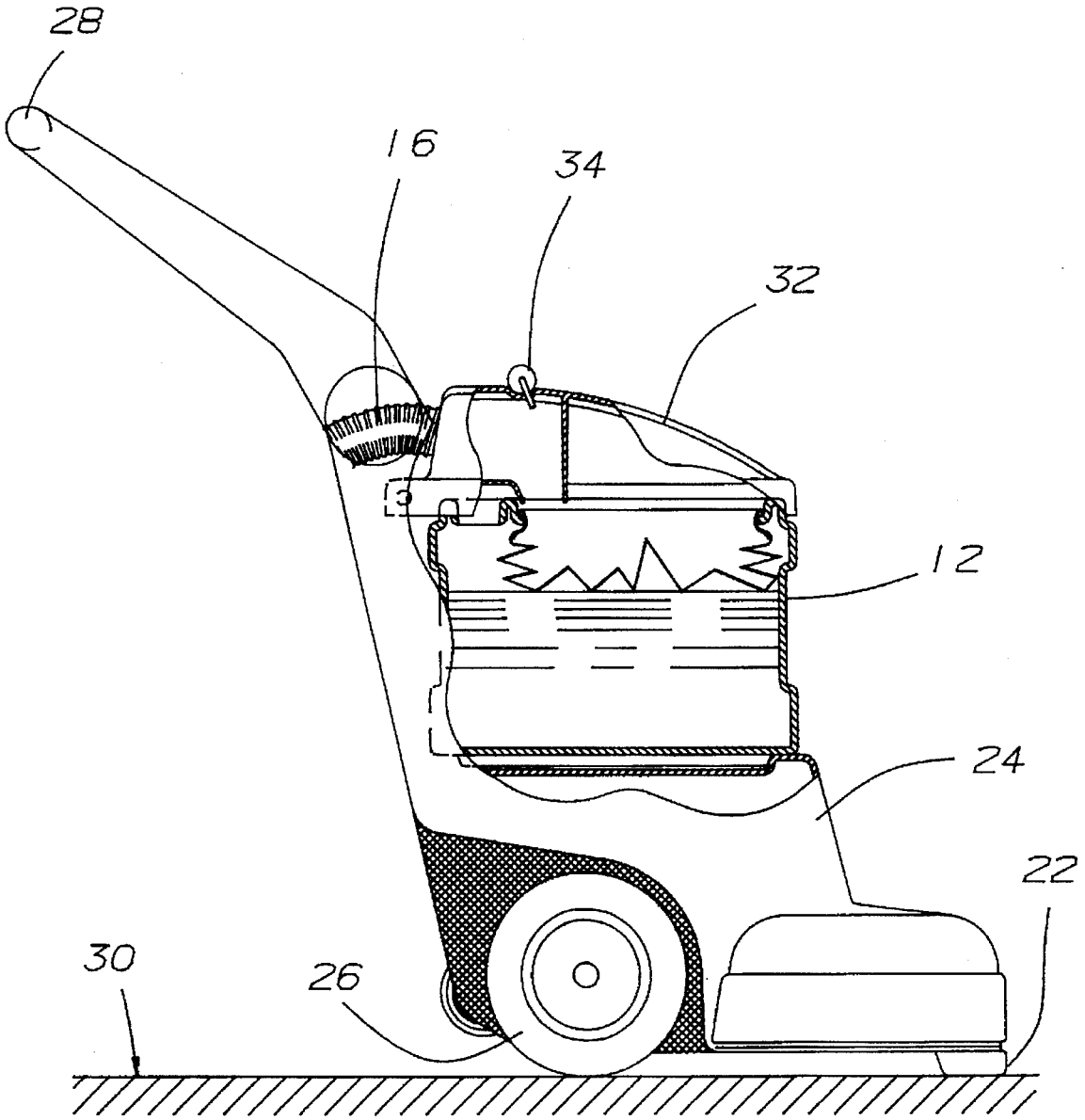
FIG. 3 is a side view in partial section of the machine of FIG. 1 showing the machine filled with clean liquid and ready for cleaning.

Considering the drawings in more detail, the flaccid container 10 serves as a reservoir for spent or used liquid. The flaccid container 10 is received in outer rigid clean liquid container 12 which is capable of retaining the vacuum generated by vacuum motor 14 which, in turn, communicates with container 12 via flexible hose 16.

The clean liquid is pumped by pump 18 via suction line 19 and line 20 to the floating brush assembly 22. The suction line is preferably provided with a filter 23. The structural details of the brush assembly 22 are contained in U.S. Pat. No. 4,976,003, the disclosure of which is incorporated herein by reference.

The machine has an outer case 24, carried on wheels 26 and is provided with handle 28 for pushing the machine along the floor surface 30. The top of container 12 has a hinged air-tight closure 32. The container 12 has a carrying handle 34. The handle 34 moves up and over the curved surface of closure 32 to engage recess 36 therein with a snap fit to hold the closure 32 onto the container 12 for transportation purposes.

Figure 6:
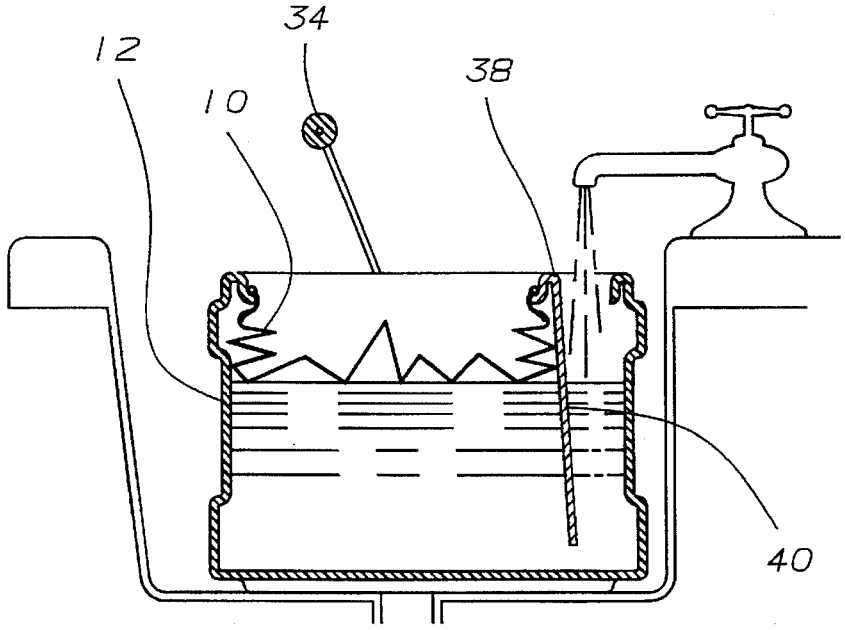
FIG. 6 shows the outer container of FIG. 5 being filled with fresh cleaning fluid.
Figure 7:
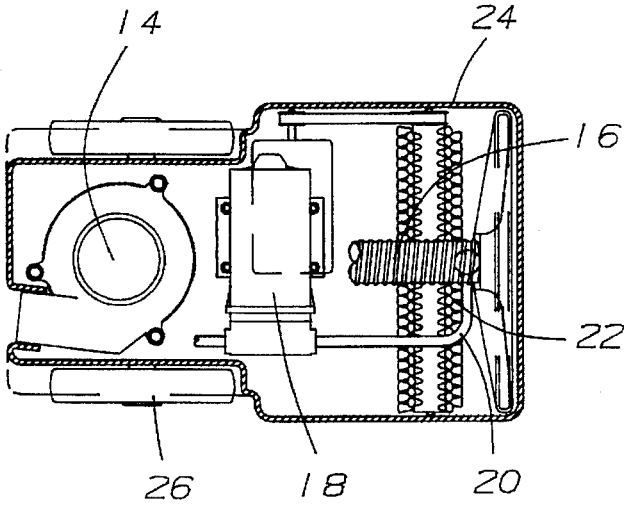
FIG. 7 is a view taken from the top of the machine looking down with the upper portion of the machine including the inner and outer containers being taken away to facilitate understanding.
Figure 8:
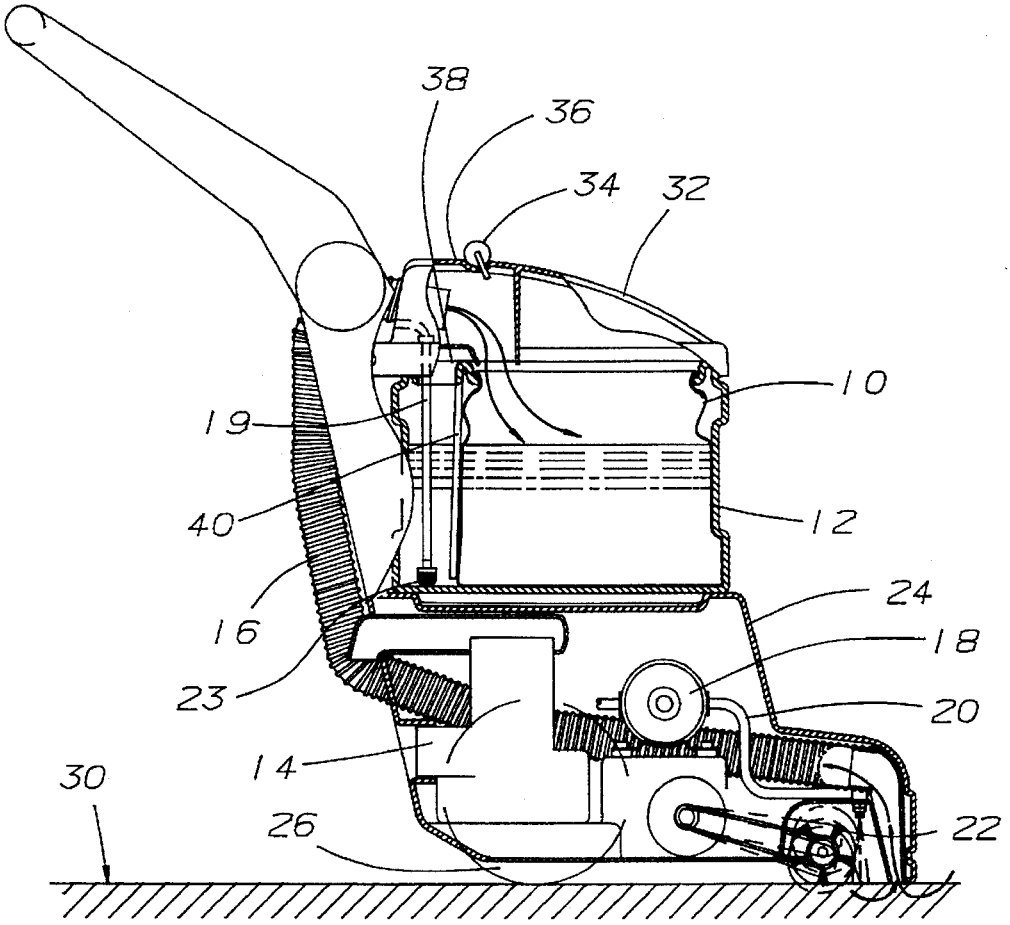
FIG. 8 is a side view of the machine in partial section to further facilitate understanding.
Figure 9:
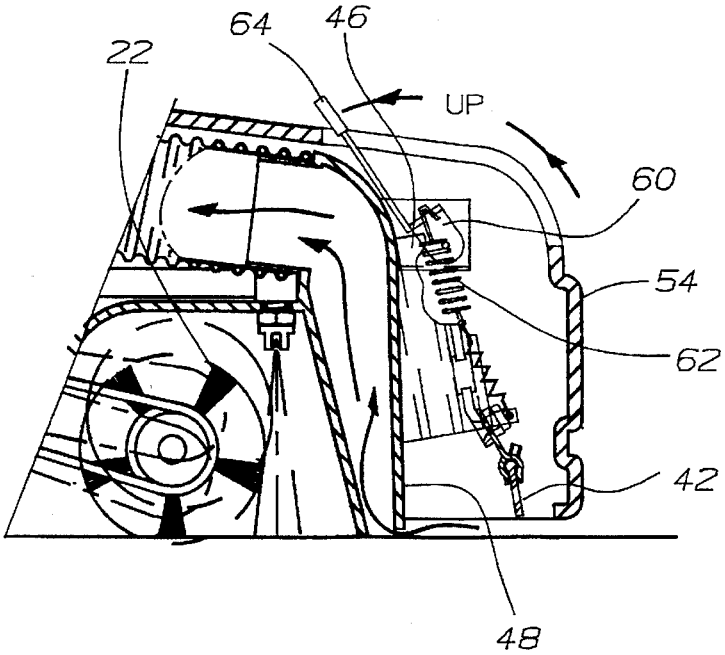
FIG. 9 is a side, partial section view of the side of the brush and squeege elements of the preferred machine of this invention with the squeege shown in the raised or up position.
Figure 10:
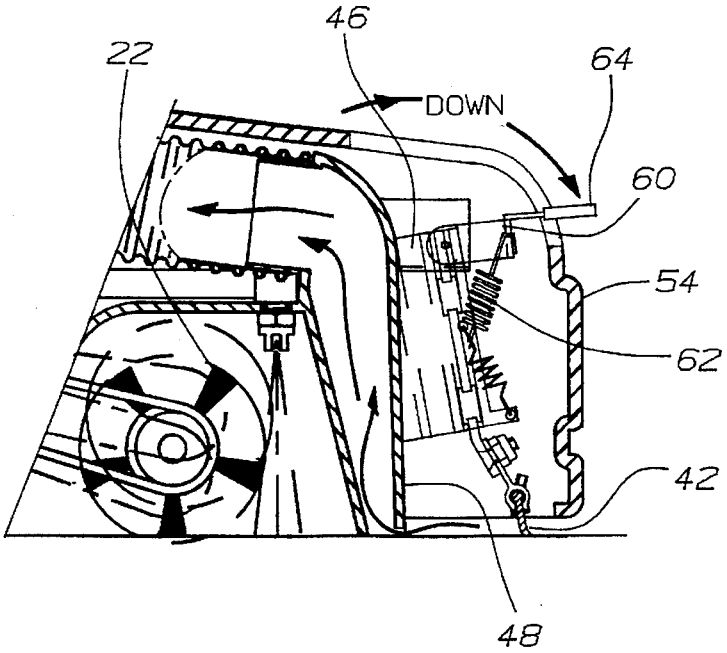
FIG. 10 is similar to FIG. 9 with the squeege shown in the down position, engaging the surface being cleaned.
Figure 11:
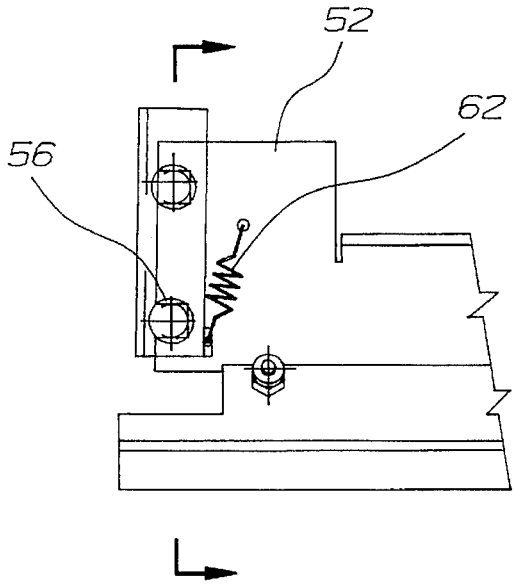
FIG. 11 is a top view of a part of the squeege mechanism.
Figure 12:
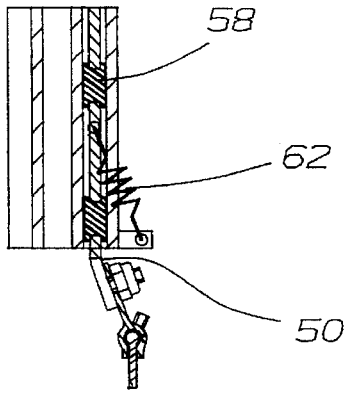
FIG. 12 is a section taken along line 11—11 in FIG. 11.

In use, container 12 is filled with clean water or other cleaning solution as shown in FIG. 6 which shows a spigot and sink as an example. Filling is accomplished via opening 38 which is formed by the top edge of container 12 and the rigid partition 40. The flaccid container 10 is not quite extensive with the area of the top of container 10 and thus does not extend into the space occupied by opening 38. The flaccid container 10 is expandable when filled to substantially occupy the total interior space of container 12 and to be fully supported by it, eliminating stress on the flaccid container.

The container 10 may be detachably attached or permanently attached to the periphery of container 12. Preferably, the container 10 is of a drop in or clip in design holding itself to the upper periphery of container 12. The filled container 12 can be carried like a wash pail by handle 34 and simply placed on the machine as in FIG. 1.

Figure 4:
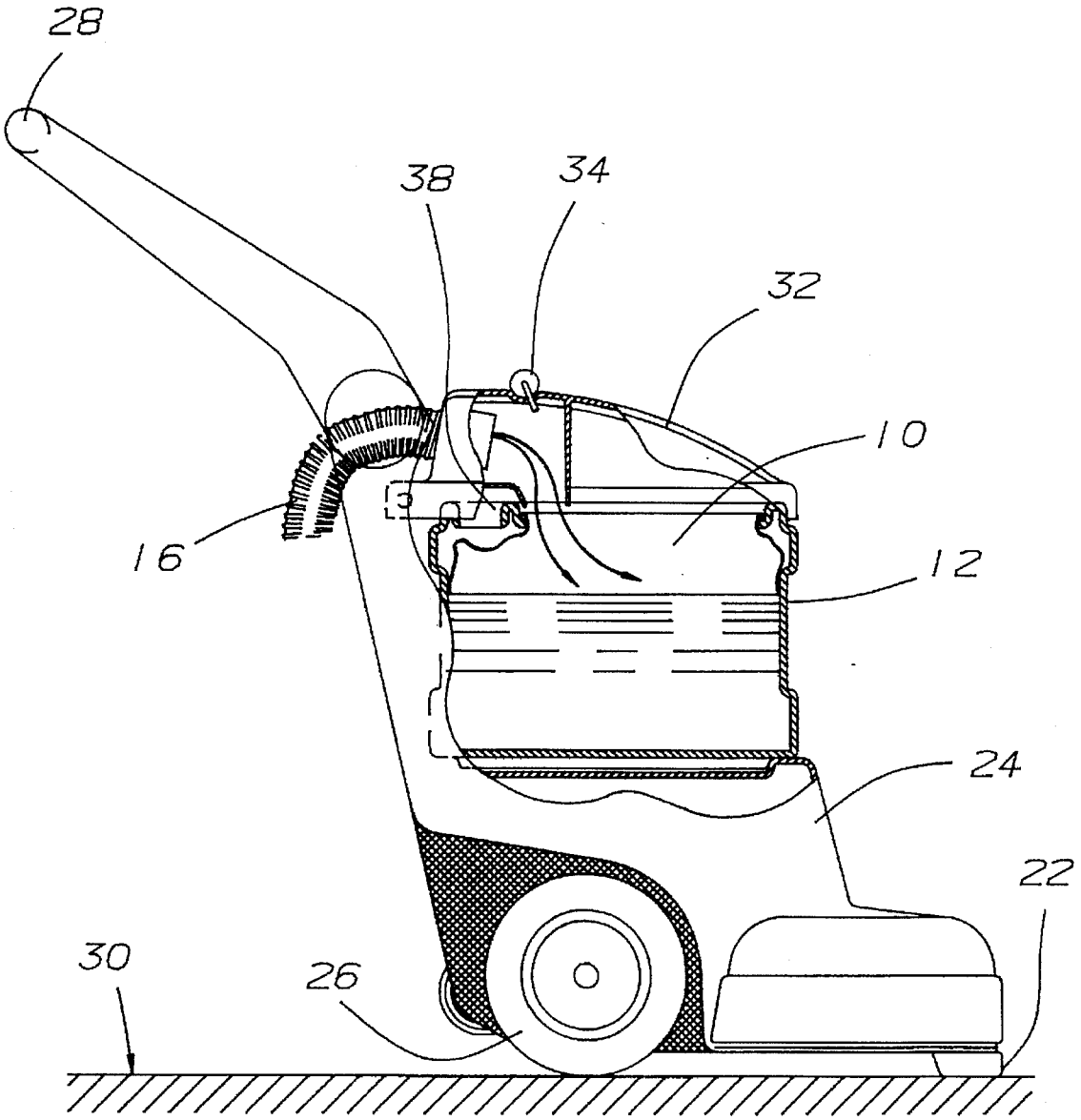
FIG. 4 is similar to FIG. 3 and showing the return flow of spent liquid to the flaccid container during operation of the machine.
Figure 5:
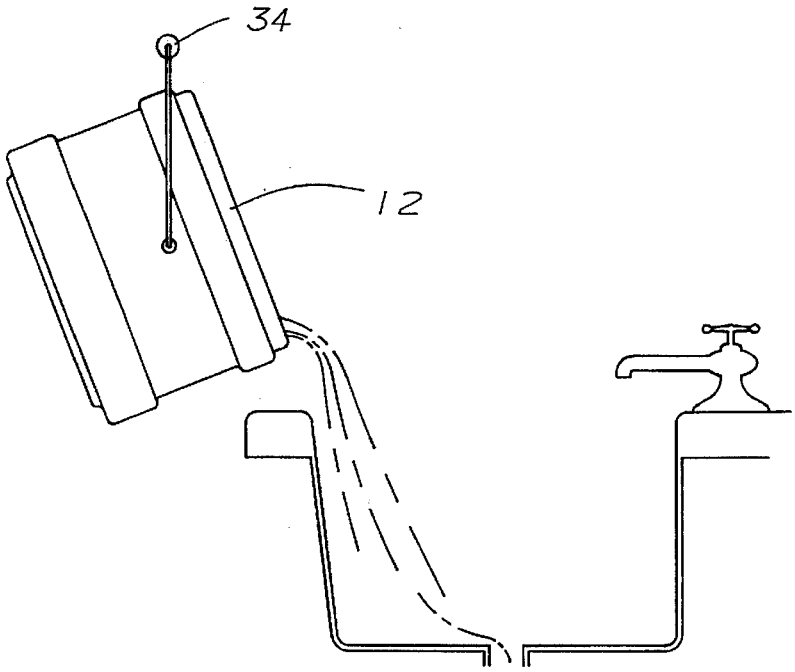

After the cleaning fluid has been used and thereby transferred from container 12 to container 10 as shown in FIG. 4, the closure 32 can be opened, the combined containers 10 and 12 lifted out and the contents dumped as shown in FIG. 5.

Thus, it can be seen that this invention permits the filling and emptying of the machine in a manner which is familiar and comfortable to the user while at the same time the machine operates in an efficient and highly effective manner.

FIGS. 9 to 12 show a preferred embodiment wherein the machine is provided with a full floating squeege. The full floating squeege 42 is attached to the inner housing 44 in such a manner so as to permit the squeege to move up and down as well as tilt left to right. In this regard channel-like tracks 46 are affixed to the wall 48 of the inner housing 44 so as to position the floating squeege therebetween. The floating squeege 42 includes a slider plate 50 disposed adjacent to wall 48 which provides outwardly extending flange 52 extending substantially the length of the vacuum head 54.

Each flange 52 is disposed within a respective track 46 in such a manner so as to permit the flanges 52 to move upwardly and downwardly therein. Each flange 52 includes recesses 56 which receive a self-lubricating glider 58, which serves to space the flange 52 from the respective tracks 46 to minimize frictional contact therebetween.

An upper bracket 60 is fixed to the slider plate 50 of the floating squeege 42, and provides an anchor for an upper end of a spring 62. The lower end of the spring 62 is anchored to the track 46. The spring 62 provides a biasing force tending to urge the floating squeege 42 downwardly to place the squeege adjacent to the surface to be cleaned. The squeege can be raised or lowered by handle 64.

This preferred embodiment provided with a full floating squeege is adapted for cleaning of both carpeted and hard floor surfaces. By moving handle 64, the machine can move from carpet to hard floor.

The construction of the full floating squeege so that it can tilt left to right enables effective use of the squeege on uneven floor surfaces and is an important feature of this embodiment of the invention.

Having fully described the invention, it is intended that it be limited only by the lawful scope of the appended claims.

We claim:

1. A free standing floor cleaner having a body including;

a case which has a generally horizonal upper supporting surface, said case having wheels provided at the rear of the case for rolling the cleaner over the floor and a cleaning head supporting the front of the case, a separable, vacuum-retaining, rigid clean liquid container having an open top and an opposed closed bottom, said rigid clean liquid container being disposed within said case and on said horizonal upper supporting surface, a flaccid container within said rigid clean liquid container serving as a reservoir for a return of a spend liquid, said case including liquid pumping means communicating with said rigid clean liquid container for discharging a clean liquid from said clean liquid container on to a surface to be cleaned, said case further including means for creating vacuum within said rigid clean liquid container in and around said flaccid container, a means communicating with said flaccid container for drawing said spent liquid and included dirt from said surface to be cleaned, through said cleaning head, and into said flaccid container under the influence of said vacuum, and a means for lifting said rigid clean liquid container and flaccid container as a unit from said horizontal upper supporting surface by upward a vertical force for separation from said case whereby said unit is removable for disposing of spent and clean liquids contained therein, cleaning the containers, and refilling with fresh cleaning fluid.

2. The free standing floor cleaner of claim 1 wherein said rigid clean liquid container is sealed by a tight fitting closure.

3. The free standing floor cleaner of claim 1 wherein said open top of said rigid clean liquid container has a liquid receiving opening and said flaccid container is attached to an upper periphery of the open top of said rigid clean liquid container.

4. The free standing floor cleaner of claim 1 wherein said cleaning head includes a floating brush.

5. The free standing floor cleaner of claim 1 wherein said means for lifting is a carrying handle attached to said rigid clean liquid container.

6. The free standing floor cleaner of claim 1 wherein the rigid clean liquid container is sealed by a tight fitting closure, said closure having an external recess, and wherein the rigid container has a carrying handle for carrying like a scrub bucket, and said carrying handle is slidably received in said recess in the exterior surface of said closure to hold said closure tightly in sealing relationship to said rigid clean liquid container.

7. The free standing floor cleaner of claim 1 wherein the cleaning head which includes a full floating squeegee, said full floating squeegee being adapted to tilt to permit use on uneven surfaces.

8. The free standing floor cleaner of claim 7 wherein the full floating squeegee is provided with a means for raising an lowering the full floating squeegee so as to contact the squeegee with a hard surface or to raise the full floating squeegee to permit cleaning of a carpeted surface.

9. The free standing floor cleaner of claim 1 wherein said body includes a handle which projects upwardly from the rear of said case, said handle being adapted for pushing the entire cleaner over the floor while maintaining said generally horizontal upper supporting surface generally parallel to the floor.

10. A free standing floor cleaner having a body including;

a case which has a generally horizonal upper supporting surface, said case having wheels provided at the rear of the case for rolling the cleaner over the floor and a cleaning head supporting the front of the case, a separable, vacuum-retaining, rigid clean liquid container having an open top and an opposed closed bottom, said rigid clean liquid container being disposed within said case and on said horizonal upper supporting surface, a flaccid removable container within said rigid clean liquid container serving as a reservoir for a return of a spend liquid said case including liquid pumping means communicating with said rigid clean liquid container for discharging a clean liquid from said clean liquid container on to a surface to be cleaned, said case further including means for creating vacuum within said rigid clean liquid container in and around said flaccid container, a means communicating with said flaccid container for drawing said spent liquid and included dirt from said surface to be cleaned, through said cleaning head, and into said flaccid container under the influence of said vacuum whereby said flaccid container can fill with spent liquid at a volume rate essentially equal to the rate of depletion of the clean liquid;

the improvement comprising means for lifting said rigid clean liquid container and flaccid container as a unit from said horizontal upper supporting surface by upward a vertical force for separation from said case whereby said unit is removable for disposing of spent and clean liquids contained therein, cleaning the containers, and refilling with fresh cleaning fluid.

* * * * *